US006864625B2

(12) United States Patent
Skupien

(10) Patent No.: US 6,864,625 B2
(45) Date of Patent: Mar. 8, 2005

(54) COLOR PIXEL ELEMENT CATHODE RAY TUBE

(75) Inventor: Thomas A. Skupien, Buda, TX (US)

(73) Assignee: Trepton Research Group, Inc., Santa Clara, CA (US)

( * ) Notice: Subject to any disclaimer, the term of this patent is extended or adjusted under 35 U.S.C. 154(b) by 0 days.

(21) Appl. No.: 10/352,412

(22) Filed: Jan. 28, 2003

(65) Prior Publication Data

US 2004/0222730 A1 Nov. 11, 2004

(51) Int. Cl.[7] ..... H01J 29/50
(52) U.S. Cl. ..... 313/409; 313/411; 313/446
(58) Field of Search ..... 313/414, 409, 313/421, 422, 427, 416, 432, 439, 435, 452, 461, 411, 446, 412

(56) References Cited

U.S. PATENT DOCUMENTS 4,061,941 A * 12/1977 Hallett et al. ..... 313/414
4,095,138 A * 6/1978 Schwartz ..... 315/16
4,513,221 A * 4/1985 Robbins ..... 313/402
4,766,341 A * 8/1988 Nakamura ..... 313/402
4,961,022 A * 10/1990 Hellings et al. ..... 313/414
4,961,626 A * 10/1990 Fournier et al. ..... 359/630
5,905,332 A * 5/1999 Yun et al. ..... 313/414
2001/0024078 A1 * 9/2001 Dimitrijevic et al. ..... 313/311

* cited by examiner

*Primary Examiner*—Vip Patel
*Assistant Examiner*—Glenn Zimmerman
(74) *Attorney, Agent, or Firm*—Martine & Penilla, LLP

(57) ABSTRACT

Color CRTs, used in large display screens, have a plurality of three color electron beams that are strongly focused so that they crossover and become divergent in both the X and Y axes if the CTR's face. The strength of the focusing determines the size of the illuminated area on the face of the CRT. A shadow mask, aperture grill, or slotted mask and the red, green and blue phosphor dots or stripes are located at predetermined positions such that the red electron beams only hit the red phosphors, the green electron beams only hit the green phosphors, and the blue electron beams only hit the blue phosphors. No raster scanning with the electron beams are required.

7 Claims, 2 Drawing Sheets

COLOR PIXEL ELEMENT CATHODE RAY TUBE

BACKGROUND OF THE INVENTION TECHNOLOGY

1. Field of the Invention

This invention relates to cathode ray tubes used as pixel elements in large color displays. More particularly, the invention relates to a color pixel element cathode ray tube (CTR) having three electron beams, one for ach primary color, wherein the CRT produces a range of monolithic colors.

2. Description of Related Art

Large television display screens such as a JUMBOTRON® (registered trademark of Sony Corporation) generally use a plurality of CRTs arranged in an X and Y matrix of color pixels. Light emitting diodes may be used for smaller large display screens and rear or front protection screens may also be used, but both suffer from low contrast or brightness. CRTs are used as pixel elements in the large display screens because of the brightness and superior contrast obtainable from the matrix of these pixel CRTs. Generally, each color display pixel comprises three CRTs, one for each primary color—red, green and blue. By apportioning the intensity of each of the primary colors, a range of colors may thereby be produced. In an alternate arrangement, full color CRTs may also be assembled in a matrix to produce a large display screen. In this arrangement, raster scanning is required for each CRT. Raster scanning requires that there be a magnetic deflection yoke in addition to the other required elements of a CRT, e.g., shadow mask, primary color phosphor dots (or strips), and associated electronics. Using three CRTs per color pixel element or a plurality of color CRTs in a large display screen is costly, increases the complexity and weight, and reduces reliability of the large display screen.

There is a need for high reliability and reduced cost color CRTs that may be used as pixel elements in a large display screen.

SUMMARY OF THE INVENTION

The present invention remedies the shortcomings of the prior art by providing an apparatus, system and method for producing a low cost and reliable color CRT that may be used as a pixel element having a full range of colors in a large display screen.

In an exemplary embodiment of the present invention, a CRT having three electron sources and three electron guns (one for each primary color—red, green and blue), a plurality of three groups of primary color (red, green and blue) phosphor dots or stripes, and a shadow mask, aperture grill or slotted mask, but without requiring a defection yoke or raster scanning, produces a range of monolithic colors on the face of the CRT. The CRT face may be for example 25 millimeters in diameter (or diagonally for a rectangular CRT). The three electron sources may comprise any device or method that can produce a stream of electrons that may be controlled (modulated) in intensity (quantity of electrons in the stream), e.g., heated cathode, carbon nanotube cathode or preferably a field emission array (FEA). A preferred FEA is more fully described in commonly owned U.S. patent application Ser. No. 09/356,851, entitled "Compact Field Emission Electron Gun and Focus Lens" by Gorski, et al., which is incorporated by reference herein.

In the present invention, the three electron beams in the CRT are strongly focused so that they crossover and become divergent in both the X and Y axes of the CRT face. The strength of the focusing determines the size of the illuminated area on the face of the CRT. A shadow mask, aperture grill, or slotted mask and the red, green and blue phosphor dots or stripes are located at predetermined positions such that the plurality of electron beams emanating from the red source hit the red phosphors, the plurality of electron beams emanating from the green source hit the green phosphors and the plurality of electron beams emanating from the blue source hit the blue phosphors. Thus, each color of phosphor dots or stripes are excited simultaneously by their respective electron beams. Each of the primary color (RGB) electron beams pass through a specifically located opening in the shadow mask, aperture grill, or slotted mask at angles such that the respective color phosphor dots or stripes are excited by the appropriate color electron beams and not by the other two primary color electron beams. Thus, a defection yoke and raster scan electronics are not required nor desired to produce a monolithic color on the face of the CRT, according to the present invention.

A technical advantage of the present invention is one CRT may be used per pixel in a large display screen to produce any monolithic color. Another technical advantage is any monolithic color may be produced on the face of a color CRT without using a magnetic deflection yoke or raster scanning of the electron beams.

BRIEF DESCRIPTION OF THE DRAWINGS

For a more complete understanding of the invention and the advantages thereof, reference is now made to the following description taken in conjunction with the following drawings wherein.

Figure 1:
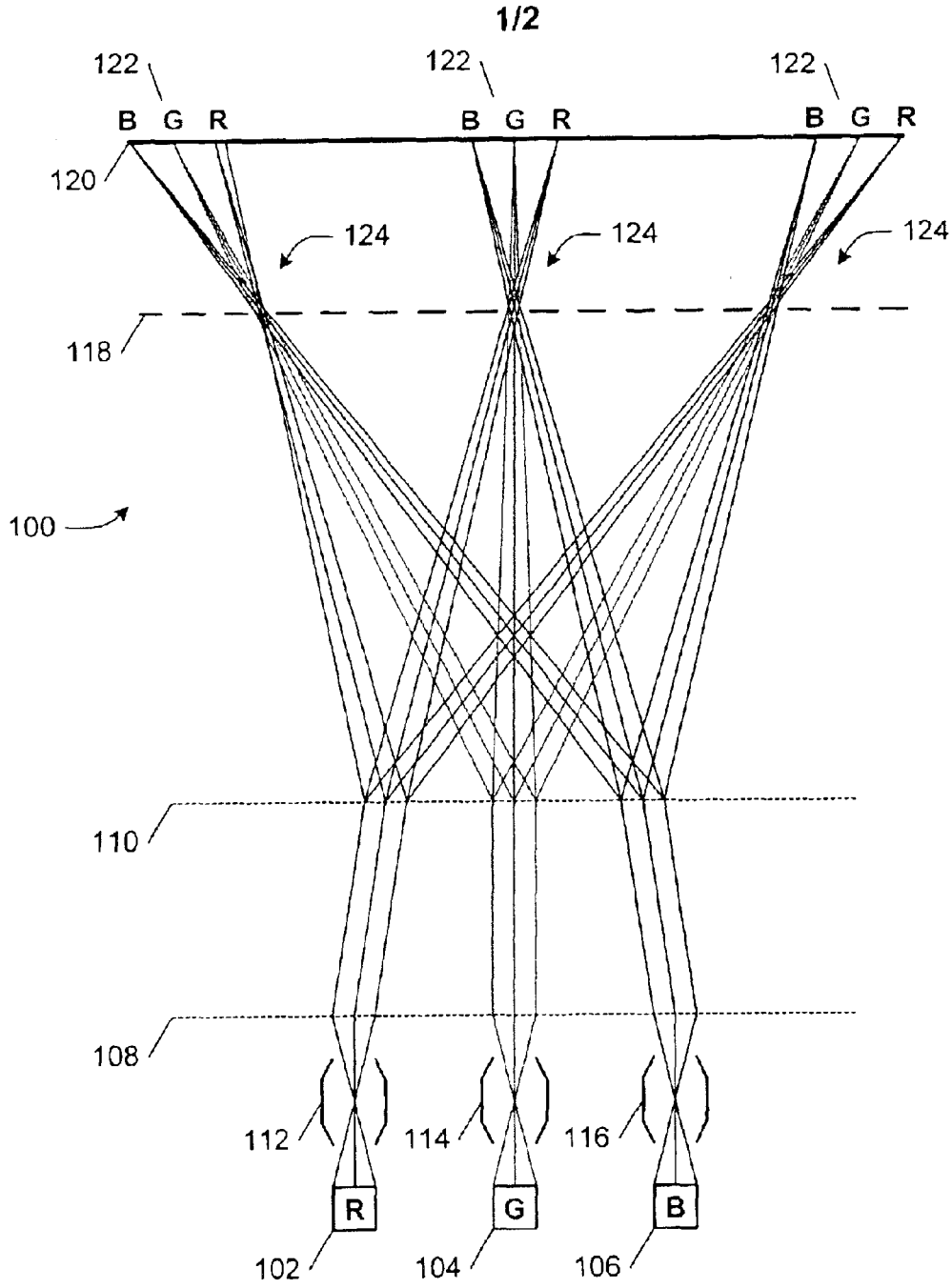
FIGURE 1 (PRIOR ART)
FIG. 1 illustrates a schematic diagram of a cross-sectional view of a prior art CRT structure and its electron beam paths.

The present invention may be susceptible to various modifications and alternative forms. Specific exemplary embodiments thereof are shown by way of example in the drawing and are described herein in detail. It should be understood, however, that the description set forth herein of specific embodiments is not intended to limit the present invention to the particular forms disclosed. Rather, all modifications, alternatives, and equivalents falling within the spirit and scope of the invention as defined by the appended claims are intended to be covered.

DETAILED DESCRIPTION OF SPECIFIC EMBODIMENTS

Referring now to the drawings, the details of an exemplary embodiment of the present invention are schematically illustrated. Like elements in the drawings will be represented by like numbers, and similar elements will be represented by like numbers with a different lower case letter suffix.

Referring to FIG. 1, depicted is a schematic diagram of a cross-sectional view of a prior art CRT structure and its electron beam paths. A CRT, generally represented by the numeral 100, comprises red, green and blue electron sources 102, 104 and 106, respectively; red, green and blue pre-focus lens 112, 114 and 116, respectively; a main lens and convergence structure 108, a yoke reference line 110 (yoke not shown), a shadow mask 118, and a CRT face 120 comprising a plurality of blue, green and red phosphor dot triads 122. Operation and construction of the CRT 100 are well known to those having ordinary skill in television CRTs. Three electron sources 102, 104 and 106, along with the associated pre-focus lens 112, 114, and 116, are illustrated in one CRT. However, prior art pixel CRTs used in large display screens, generally, may comprise only one electron source and pre-focus lens, and only one color of phosphor (or white phosphor and color filter) on the CRT face. The three color CRT 100 (prior art) require a magnetic deflection yoke to sweep the electron beams across the face 120, wherein the phosphor dot triads 122 are sequentially illuminated in a raster scan fashion. Note, beams 124 represent the same electron beam triad being sweep across the face 120 by the deflection yoke (not shown).

Figure 2:
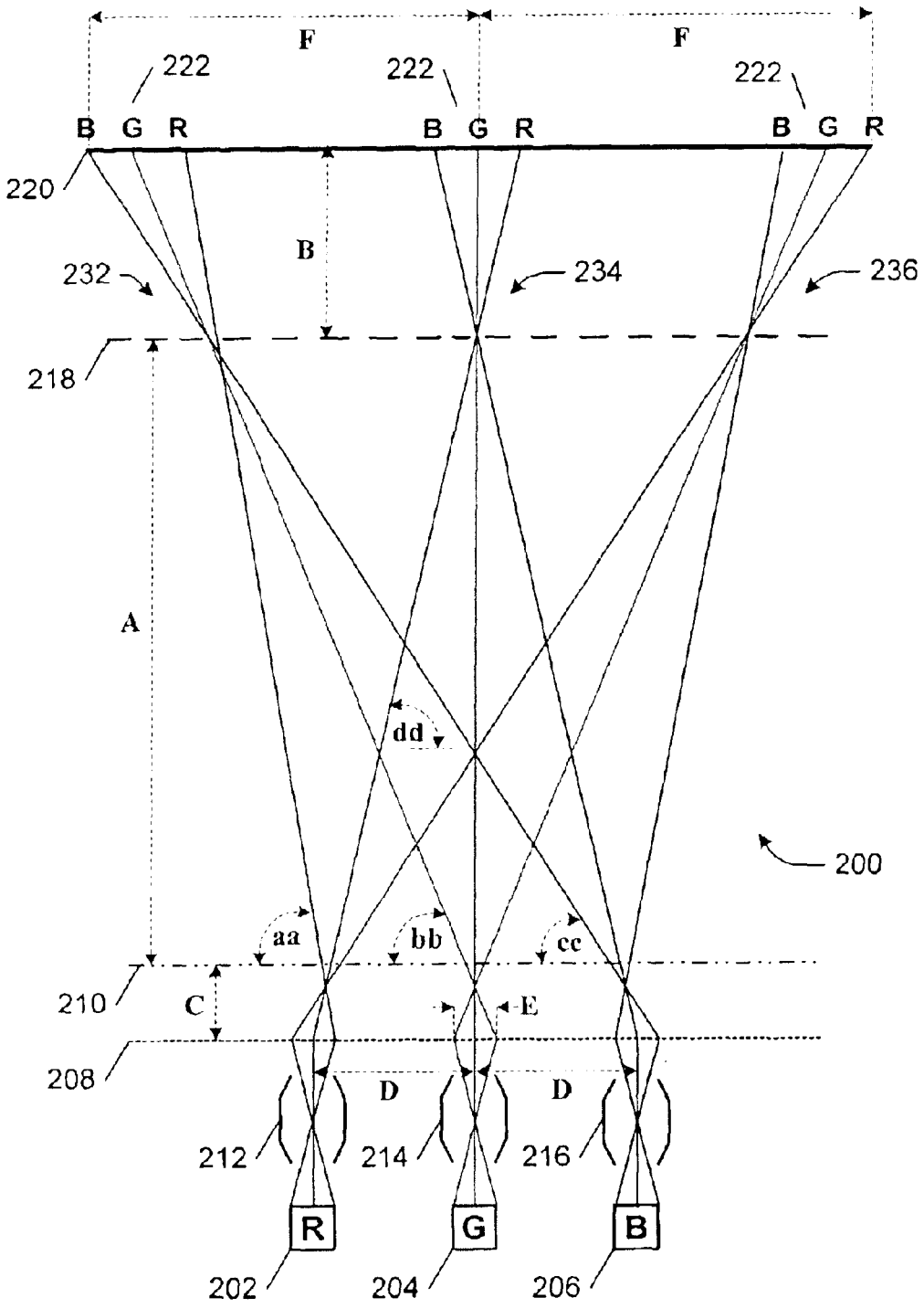
FIG. 2 illustrates a schematic diagram of a cross-sectional view of a CRT structure and its electron beam paths, according to an exemplary embodiment of the present invention.

Referring now to FIG. 2, depicted is a schematic diagram of a cross-sectional view of a CRT structure and its electron beam paths, according to an exemplary embodiment of the present invention. A CRT, generally represented by the numeral 200, comprises red, green and blue electron sources 202, 204 and 206, respectively; red, green and blue pre-focus lens 212, 214 and 216, respectively; a main lens 208, a pseudo yoke reference line 210 (no yoke required), a shadow mask 218, and a CRT face 220 comprising a plurality of blue, green and red phosphor dot triads 222.

The electron sources 202, 204 and 206 may be heated filament cathodes, well know in the art, carbon nanotube cathodes, a field emission array (FEA) more fully described in commonly owned U.S. patent application Ser. No. 09/356,851, previously incorporated by reference, etc. It is contemplated and within the scope of the present invention that an aperture grill, a slotted-mask, etc., may be used in place of the shadow mask 218. Likewise, color strips (red-green-blue), triangularly arranged elongated oval phosphor dots, rectilinear phosphor dots, etc., may be used with equally good results, according to the spirit and scope of the present invention.

A plurality of three color electron beams, schematically represented by electron beams 232, 234 and 236 are strongly focused so that they crossover and become divergent in both the X and Y axes of the CRT face 220. Only three of the plurality of three color electron beams are shown for illustrative clarity, there may be many thousands of the three color electron beams in operation simultaneously. The strength of the focusing determines the size of the illuminated area on the face of the CRT. A shadow mask, aperture grill, or slotted mask and the red, green and blue phosphor dots or stripes are located at predetermined positions such that the "red" electron beams only hit the red phosphors, the "green" electron beams only hit the green phosphors, and the "blue" electron beams only hit the blue phosphors. Thus, a defection yoke and a raster scan are not required nor desired to produce a monolithic color on the face of the CRT, according to the present invention.

For example, the distance "A" between the pseudo yoke reference line 210 and the shadow mask 218 may be about 201 mm. The distance "B" between the shadow mask 218 and the CRT face 220 may be about 15 mm. The distance "C" between the pseudo yoke reference line 210 and the main lens 208 may be about 26 mm. The distance "D" between the electron sources 202, 204 and 206 may be about 5.5 mm. The distance "E" that the electron beams are spread at the main lens 208 may be about 3 mm. The distance "F" is the radius of the CRT face 220 and may be about 12.5 mm. A square or rectangular CRT face 220 is also contemplated and within the scope of the present invention. The red electron beam 232 angle "aa" may be about 87.83°. The green electron beam 232 angle "bb" may be about 86.69°. The blue electron beam 232 angle "cc" may be about 85.45°. The red electron beam 234 angle "dd" may be about 88.85°. Other distance and angular values will be readily apparent to one skilled in the art of cathode ray tube design.

Methods for beam adjustment using distortion correction circuits are well known, and are described, for example, in the book *Video Engineering*, by A. Luther et al, Mc-Graw-Hill, 1999, pp. 5–39 through 5.45, which are hereby incorporated by reference.

The invention, therefore, is well adapted to carry out the objects and to attain the ends and advantages mentioned, as well as others inherent therein. While the invention has been depicted, described, and is defined by reference to exemplary embodiments of the invention, such references do not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A color cathode ray tube (CRT), comprising:

a envelope having a neck and a face with a phosphor coated screen thereon, the phosphor coated screen comprising a plurality of red, green and blue phosphor dots;

red, green and blue electron gun assemblies, each having a source end and electrodes for focusing an electron beam therethrough, the red, green and blue electron guns being disposed in the neck of the CRT;

three electron sources disposed at the source ends of the red, green and blue electron gun assemblies; and a shadow mask positioned between the red, green and blue electron gun assemblies, the shadow mask having a plurality of openings, wherein the red, green and blue electron gun assemblies simultaneously focus their respective electron sources into a plurality of electron beams that selectively pass through the plurality of openings such that the electron beams from the red electron gun assembly excites each of the red phosphor dots, the electron beams from the green electron gun assembly excites each of the green phosphor dots, and the electron beams from the blue electron gun assembly excites each of the blue phosphor dots.

2. The CRT according to claim 1, wherein the three electron sources are heated filament cathodes.

3. The CRT according to claim 1, wherein the three electron sources are carbon nanotube cathodes.

4. The CRT according to claim 1, wherein the three electron sources are field emission arrays.

5. The CRT according to claim 1, wherein the face of the CRT is equal to or less than about 25 millimeters in diameter.

6. The CRT according to claim 1, wherein the face of the CRT is round.

7. The CRT according to claim 1, wherein the face of the CRT is rectangular.

* * * * *